United States Patent [19]

Benson

[11] 4,019,604

[45] Apr. 26, 1977

[54] ELEVATING PLATFORM APPARATUS

[75] Inventor: Lyman David Benson, Santa Rosa, Calif.

[73] Assignee: Fabtek, Inc., Healdsburg, Calif.

[22] Filed: June 16, 1975

[21] Appl. No.: 587,354

[52] U.S. Cl. ..... 182/2; 182/63; 182/141

[51] Int. Cl.[2] ..... B66F 11/04

[58] Field of Search ..... 182/2, 141, 148, 63; 212/8, 144, 17; 187/18

[56] References Cited

UNITED STATES PATENTS

| | | | |
|---|---|---|---|
| 3,768,591 | 10/1973 | Stucky | 182/2 |
| 3,807,575 | 4/1974 | Merrick | 212/8 |
| 3,828,939 | 8/1974 | Tranchero | 212/8 |

*Primary Examiner*—Reinaldo P. Machado
*Attorney, Agent, or Firm*—Flehr, Hohbach, Test, Albritton & Herbert

[57] ABSTRACT

Apparatus is disclosed for elevating a platform of the type adapted to carry workers, tools, equipment and/or material. Parallelogram boom assemblies support the platform from a mobile frame such that the platform can be raised and lowered in a level attitude. Each boom assembly comprises a compression arm and a tension arm. The two boom assemblies are interconnected by means of a floating frame and a rigid tension member which is arranged to raise and lower the upper boom assembly relative to the floating frame as the lower boom assembly is raised and lowered, respectively, relative to the mobile frame. In one embodiment the upper and lower boom assemblies lie in a horizontal orientation when in their retracted mode. In another embodiment an upstanding support carries the lower boom assembly which inclines downwardly in the retracted position and connects through a floating frame with an upper boom assembly which is formed with a zigzag shape.

4 Claims, 4 Drawing Figures

ELEVATING PLATFORM APPARATUS

BACKGROUND OF THE INVENTION

This invention in general relates to aerial lift apparatus, and in particular relates to apparatus for moving a structure such as an operator's platform, basket, tools or material to an elevated position.

A number of different designs have been provided in the prior art for raising a platform or other structure to an elevated position to perform various tasks, such as in the construction industry or for maintenance work to move workers, tools or materials to different elevations.

For reaching higher elevations the prior art apparatus have employed multiple booms in which a lower boom is raised relative to a support frame, and one or more secondary booms are raised relative to the lower boom. In many instances it is necessary that the platform maintain a level attitude as it is raised. To accomplish this the prior art apparatus have employed different design solutions. However, these prior art apparatus have not been completely satisfactory because of their complexity, cost of construction, high maintenance requirements, and the necessity for periodic field adjustment to maintain proper operation. Although certain prior art devices operate with manual sychronization of the lower and secondary booms, it is desirable to provide automatic machine controlled synchronization.

Among the prior art devices of the foregoing nature are those in which the lower boom is raised from the support frame by means of a first hydraulic cylinder while the secondary boom is raised relative to the lower boom by means of a second hydraulic cylinder, with hydraulic circuitry being provided to extend and retract the cylinders conjointly so that the two booms are moved in a manner which maintains a level orientation of the platform. However, in such an arrangement it is difficult to maintain the booms in proper synchronization because of factors such as fluid leakage from the cylinders and changes in oil viscosity with temperature. Moreover, such a design is relatively complex and expensive to build and maintain.

Another prior art elevating platform apparatus is of the type shown in U.S. Pat. No. 3,231,044 which provides a pair of articulated tubular booms. The upper boom is elevated relative to the lower boom by means of a cable which is reeved around a pulley secured to the side of an hydraulic actuator mounted within the lower boom. With the actuator hydraulically locked, the relative movement between the actuator and the lower boom as the latter is elevated causes the cable to pivot the upper boom. Such an apparatus, however, is relatively complicated and expensive, and requires periodic maintenance and adjustment of the cable and pulley arrangement. Thus, there is a requirement for an aerial lift apparatus which will obviate the problems and shortcomings of existing designs.

OBJECTS AND SUMMARY OF THE INVENTION

It is a general object of the invention to provide a new and improved apparatus for elevating a structure such as a platform, basket, tools or materials and the like.

Another object is to provide apparatus of the type described which will smoothly raise and lower the structure while maintaining a level attitude.

Another object is to provide elevating platform apparatus of the type described which is relatively simple in design, inexpensive to manufacture and has relatively low maintenance and field adjustment requirements.

Another object is to provide elevating platform apparatus of the type described which will eliminate many of the component elements such as cables, chains, and pulleys which are required in existing elevating platform devices.

Another object is to provide elevating platform apparatus of the type described which is relatively compact, which has a low profile stowage capability, and which can be carried on a relatively small mobile vehicle.

Another object is to provide elevating platform apparatus of the type described in which any desired number of boom extensions may be provided for carrying a platform which will position workers, tools and/or materials at the desired elevation for the task which is to be performed.

Another object is to provide elevating platform apparatus of the type described which will find wide use in various applications such as the construction industry or for maintenance work and which will eliminate the requirement for ladders, scaffolding, forklift baskets and the like.

The elevating platform apparatus of the invention includes, in summary, a mobile support base or vehicle which carries articulated parallelogram boom assemblies upon which the platform is mounted. The lower boom assembly comprises parallel compression and tension arms which are pivotally mounted at their proximal ends to the vehicle, and a floating frame is pivotally mounted at their distal ends. The upper boom assembly also includes compression and tension arms which are pivotally mounted at their proximal ends to the floating frame and are pivotally mounted at their distal ends to an end frame from which the platform is carried. An actuator is provided to pivot the lower boom relative to the main frame whereby the floating frame is elevated while maintaining a steady level attitude. A rigid tension force transmitting member is interconnected between arms of the two boom assemblies so as to impart a moment force which pivots the upper boom assembly relative to the floating frame as the lower boom assembly is pivoted relative to the vehicle. In one embodiment the two boom assemblies extend horizontally from the floating frame over the main frame in the retracted or stowed mode. In another embodiment the lower boom, in the retracted mode, is inclined downwardly from an upstanding post on the main frame and carries a floating frame. The upper boom is inclined downwardly from the floating frame and is formed with a zigzag shaped portion which allows the two booms to retract side-by-side.

The foregoing and additional objects and features of the invention will become apparent from the following description in which the preferred embodiments have been set forth in detail in conjunction with the accompanying drawings.

DESCRIPTION OF THE PREFERRED EMBODIMENTS

Figure 1:
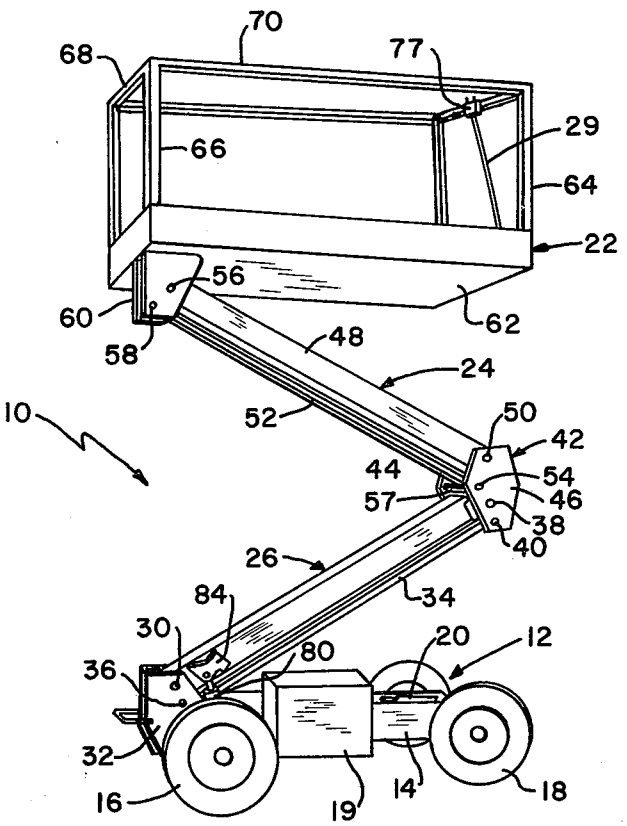
FIG. 1 is an elevational view of an elevating platform apparatus constructed in accordance with one embodiment of the invention.
Figure 2:
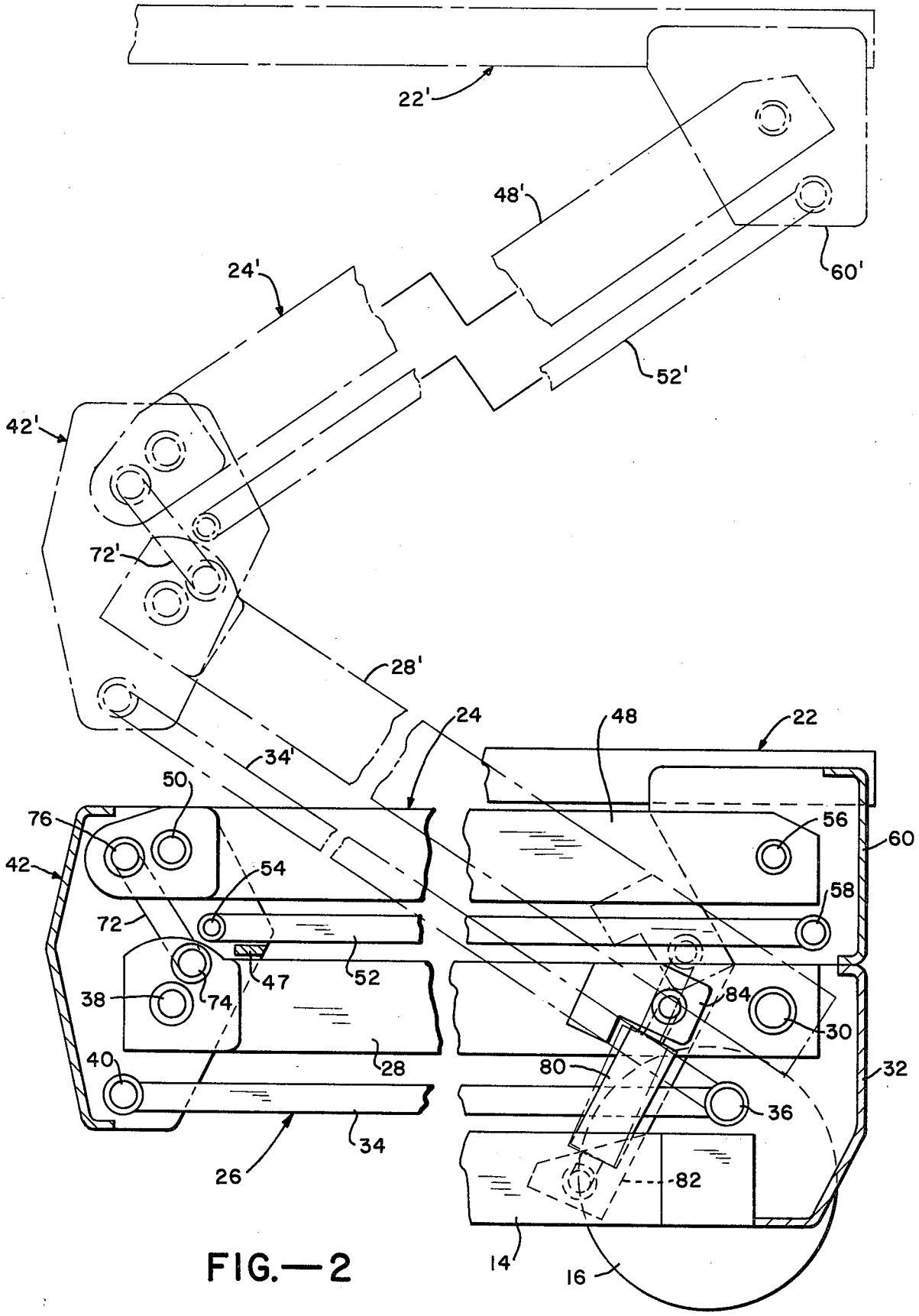
FIG. 2 is a fragmentary side elevation view, partially cut-away and to an enlarged scale, of the apparatus shown in FIG. 1.

In the drawings FIGS. 1 and 2 illustrate generally at 10 an elevating platform apparatus incorporating one embodiment of the present invention. Apparatus 10 is adapted for use in construction applications where tools, equipment or material are to be loaded at ground level and then raised to the desired elevation, such as to an upper floor level, alongside a wall or beneath a ceiling at a construction project or in an existing building.

Apparatus 10 includes a mobile support base or vehicle 12 which comprises a frame 14 supported above the ground or floor by means of front and rear pairs of pneumatic tired drive wheels 16, 18. The drive wheels can be powered by means of suitable hydraulic or electric motors, not shown. The hydraulic motors can be supplied with pressurized fluid from a pump driven by a suitable electric or gasoline motor. Front wheels 18 are mounted on the frame by a suitable steering linkage operated by suitable means such as a hydraulic cylinder 20 or ball screw actuator for controlling steering of the vehicle.

A platform 22 is carried above the support base by means of upper and lower parallelogram boom assemblies 24, 26. The boom assemblies are articulated together in a manner to be described for raising and lowering the platform in a level attitude between the retracted or stowed mode shown in solid line in FIG. 3, and the fully elevated mode illustrated in phantom line at 22'. The platform mounts a control panel 27 which is connected by a cable 29 through the boom assemblies to a suitable hydraulic or electrical control circuit on the frame which operates the wheel drive motors, steering actuator 20, and lift actuator.

Lower boom assembly 26 includes an elongate compression arm 28 pivotally mounted at its proximal end through pin connection 30 with an upstanding U-shaped bracket 32 mounted at one end of frame 14. Compression arm 28 is formed of a metal tubular construction, preferably rectangular in cross-section. Boom assembly 26 further includes an elongate tension arm 34 positioned below the arm 28 and pivotally mounted at its proximal end through pin connection 36 with bracket 32 at a position spaced from pin connection 30. Tension arm 34 is also formed of a metal tubular construction, preferably rectangular in cross-section.

The distal ends of the compression and tension arms 28 and 34 are pivotally mounted at respective pin connections 38, 40 to the lower end of a generally U-shaped floating frame 42. The frame 42 included a pair of upstanding laterally spaced side plates 44, 46 through which the pin connections are mounted. A cross brace 47 is secured across the mid-portions of the side plates. The pin connections 38 and 40 are spaced apart on the side plates a distance equal to the spacing between pin connections 30 and 36. The distances along the compression and tension arms between the pin connections 30, 38 and 36, 40 are also equal so that the arms together with the floating frame and base define a four-bar parallelogram linkage. The floating frame thereby maintains a level attitude as it is raised and lowered by boom assembly 26 due to the parallelogram linkage arrangement.

Upper boom assembly 24 includes an elongate compression arm 48 mounted at its proximal end through pin connection 50 between the upper ends of the side plates of floating frame 42. Compression arm 48 is formed of a metal tubular construction, preferably rectangular in cross-section. Boom assembly 24 further includes an elongate tension arm 52 positioned below arm 48 and mounted at its proximal end through pin connection 54 between the upper ends of the side plates of the floating frame. Tension arm 52 is also formed of a metal tubular construction, preferably rectangular in cross-section. The distal ends of arms 48 and 52 are mounted through respective pin connections 56 and 58 between the sides of an upstanding channel-shaped end frame 60. The pivot connections 56 and 58 are spaced apart a distance equal to the spacing between pivot connections 50 and 54, and the distance between the connections along compression arm 48 and tension arm 52 are also evenly spaced so that a four bar parallelogram linkage is formed. Pivotal movement of the arms 48 and 52 relative to floating frame 42 thereby moves end frame 60 up and down in a level attitude.

Platform 22 is fixedly mounted at one end on the upper side of end frame 60 and projects substantially over the boom assemblies and support base. The platform includes a floor 62 which supports four upstanding corner posts 64, 66 upon which are mounted horizontally extending safety rails 68, 70. Floor 62 thereby moves with end-frame 60 so that the platform maintains a level attitude as the boom assemblies are raised and lowered. For certain applications, to achieve a greater horizontal reach, the platform could be mounted to extend in an opposite direction from that illustrated, i.e. in a direction away from the vehicle rather than over it. In such case the upper and lower arms of the upper boom would be formed as tension and compression arms, respectively, to resist the clockwise direction of rotation, as viewed in FIG. 2 of the platform with respect to the distal end of the upper boom.

Rigid tension force transmitting means comprising a tension link 72 is provided for pivoting upper boom assembly 24 in synchronization with lower boom assembly 26. Tension link 72 is pivotally mounted at its lower end through pin connection 74 to the distal end of compression arm 28 of the lower boom assembly. The upper end of the link is pivotally mounted through pin connection 76 to the proximal end of compression arm 48 of the upper boom assembly. The tension link is preferably of tubular metal construction. The link can be of relatively small cross-sectional size to apply the boom operating force in tension, as compared to the size of a link that would be required to apply the same force in compression.

Tension link 72 is interconnected between the upper and lower compression arms in a manner which translates the angular rate of change between lower compression arm 28 and floating frame 42 into a predetermined angular rate of change between upper compression arm 48 and the floating frame. This is achieved in the invention by positioning pin connection 74 at the lower end of link 72 at a pedetermined spacing, on the order of 3½ inches in the illustrated embodiment, from the pin connection 38 between the same arm and floating frame 42. This spacing provides a sufficient moment arm for applying the required force to operate the upper boom assembly and at the same time permits the link and floating frame to be assembled in a relatively compact unit. In the illustrated embodiment the tension link 72 and pin connections are arranged so that the upper boom is pivoted at an equal angular rate relative to the lower boom. As desired, the elements could be sized and positioned to vary the relationship of movement between the booms, for example the design could provide for a 2:1 ratio of angular rate of pivoted movement between the upper and lower booms.

The clockwise angular movement, as viewed in FIG. 2, of lower compression arm 28 relative to the floating frame is applied through tension link 72 as a moment force which pivots the upper compression arm counterclockwise relative to the floating frame. Similarly when the platform is lowered the lower compression arm pivots counterclockwise relative to the floating frame. The tension link serves to restrain downward movement of the upper boom assembly and platform due to gravity so that the upper compression arm pivots clockwise about the floating frame.

The configuration and interconnecting relationship between the boom assemblies, floating frame and tension link result in the steady vertical movement of platform 72 in a level attitude without any change in attitude. Where the elements are arranged as shown for apparatus 10 to provide equal angular rates of boom movement, any horizontal displacement or sway is substantially eliminated. This serves to minimize any discomfort to a workman riding in the platform. As lower boom assembly 26 is raised, floating frame 42 moves with a level attitude in an arcuate path such that its horizontal component of motion ($x$) with respect to vehicle 14 is in accordance with the formula $x = L \cos \theta$, where $L$ is the length of lower compression arm 28 and $\theta$ is the included angle between this lower arm and the horizontal. Similarly, the horizontal component of motion ($x_1$) of platform 22 with respect to the floating frame is in accordance with the formula $x_1 = L_1 \cos \theta_1$ where $L_1$ is the length of upper compression arm 48 and $\theta_1$ is the included angle between this arm and the horizontal. In the invention the two compression arms 28, 48 are of equal length, i.e., $L = L_1$, and the previously described interconnection of tension link 72 between the compression arms results in the rate of angular change of $\theta$ being equal to the rate of angular change of $\theta_1$. As a result, the horizontal displacement $x$ of the floating frame relative to the base is cancelled out by the equal and opposite horizontal displacement $x_1$ of the platform relative to the floating frame.

Lower boom assembly 26 is raised and lowered for elevating and retracting platform 22 by means of a linear actuator, preferably comprising the extensible hydraulic cylinder 80. Cylinder 80 is pivotally mounted at its head end to a bracket 82 secured to vehicle frame 14, and is also pivotally mounted at its rod end to a bracket 84 secured to the lower end of lower compression arm 28. The cylinder is operated by pressurized fluid from the hydraulic control circuit under influence of control panel 27.

In operation of the embodiment of FIG. 1, platform 22 and the two boom assemblies 24 and 26 are initially in the retracted or stowed mode illustrated in solid line in FIG. 2. In this mode the apparatus has a relatively low profile height and low center of gravity. The floor 62 of the platform is at a relatively low elevation so that it is easily accessible from the ground for loading of equipment or material. The operator then manipulates the controls on panel 27 for operating the control circuitry to extend actuator 80. As the actuator extends and pivots lower boom assembly 26 upwardly, floating frame 42 is conjointly pivoted upwardly through an arc in a level attitude. Pin connection 74 at the distal end of lower compression arm 28 thereby moves clockwise relative to pin connection 38 so that a tension force is applied through link 72. This force acts through the moment arm between pin connections 76 and 50 to pivot upper compression arm 48 counterclockwise at an equal angular rate relative to the floating frame. The resulting upward pivotal movement of the upper boom assembly elevates platform 22 upwardly in a level attitude, with the relative horizontal component of movement between the platform and floating frame being cancelled out by the opposite relative horizontal component of movement between the floating frame and vehicle. When the desired elevation is reached, the controls on panel 27 are manipulated to hydraulically lock actuator 80 so that the equipment or materials can be unloaded from the platform. Thereafter, the controls are again operated to retract the actuator so that the boom assemblies pivot downwardly and lower the platform to its retracted mode.

Figure 3:
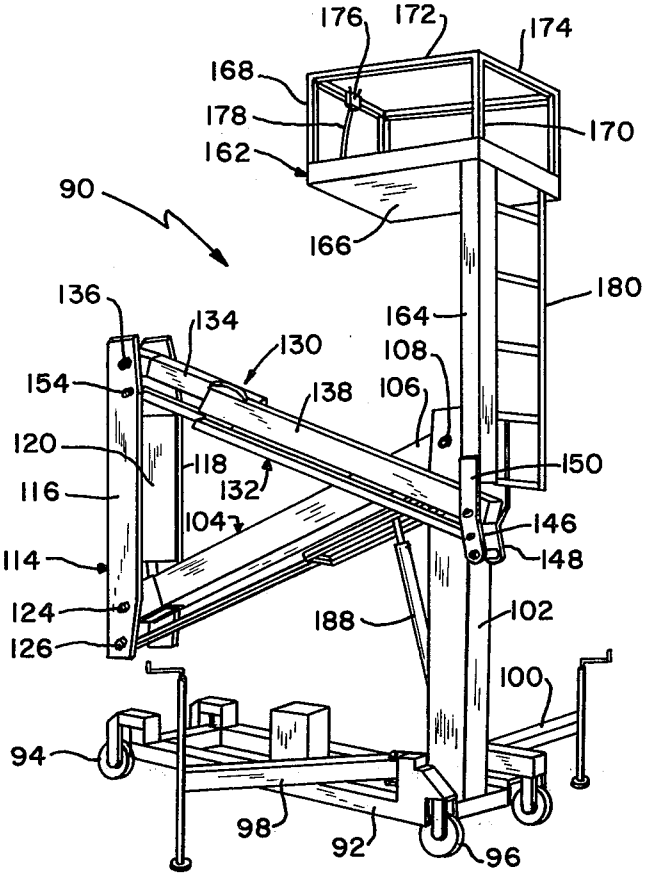
FIG. 3 is a perspective view of an elevating platform apparatus constructed in accordance with another embodiment of the invention.
Figure 4:
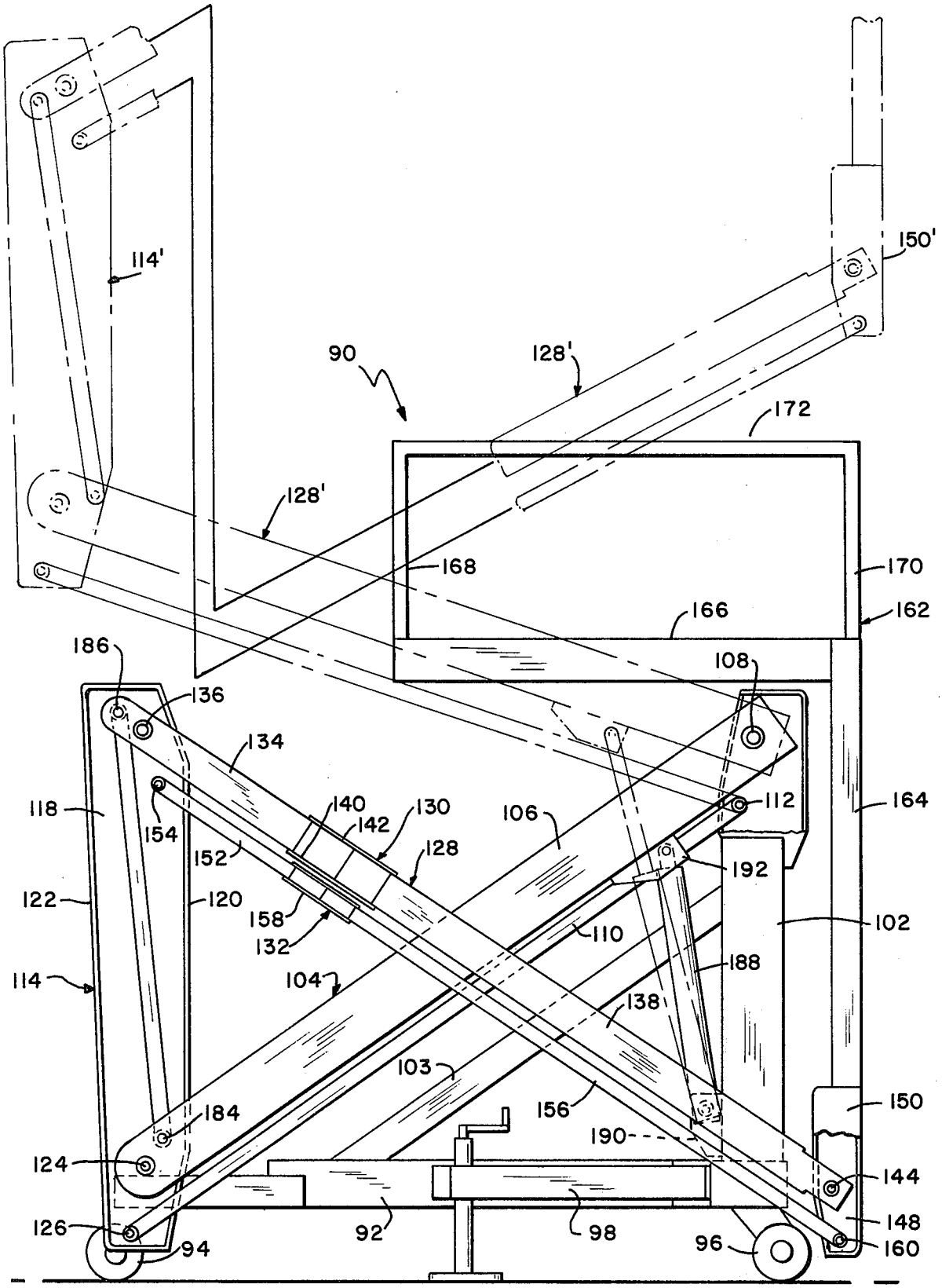
FIG. 4 is a side elevation view, partially cut-away and to an enlarged scale, of the apparatus shown in FIG. 3.

FIGS. 3 and 4 illustrate another embodiment of the invention comprising apparatus 90 specially adapted for use in applications where a greater vertical reach is desired, such as maintenance or construction work where a workman is to be carried to an elevation for tasks such as installing or repairing mechanical equipment, installing fire sprinklers or plumbing, and the like.

Apparatus 90 includes a support frame of base 92 formed of welded tubing to define a generally rectangular configuration in plan view. Four wheels 94, 95 are mounted through swivel connections at the corners of the frame to permit the apparatus to be moved over the supporting ground or floor. A pair of outrigger arms 98, 100 are pivotally mounted on opposite sides of the frame for providing stability to the apparatus at a work site.

An upstanding post or column 102 of elongate tubular shape is mounted at an end of frame 92. An inclined brace 103 extends between the upper end of the post and the frame to strengthen the post. A lower parallelogram boom assembly 104 is mounted at its proximal end of the post and the frame to strengthen the post. A lower parallelogram boom assembly 104 is mounted at its proximal end to the upper end of this post. Boom assembly 104 comprises an upper compression arm 106 of metal tubular construction, preferably rectangular in cross-section, which is pivotally mounted at its proximal end at pin connection 108 with the post. The lower boom assembly further includes a lower tension arm 110 of tubular metal construction, preferably rectangular in cross-section, which is pivotally mounted at its proximal end to the upper end of the post by means of a pin connection 112 which is spaced a predetermined distance from pin connection 108.

An elongate upstanding floating frame 114 is carried on the end of the lower boom assembly 104. Floating frame 114 comprises a pair of spaced-apart side plates 116, 118 which are mounted across opposite sides of spacer plates 120. The distal end of compression arm 106 is pivotally mounted between the lower ends of side plates 116 and 118 through pin connection 124, and the distal end of tension arm 110 is also pivotally mounted between the lower ends of the side plates through pin connection 126. The spacing between these pivot connections is equal to the spacing between pivot connections 108 and 112 so that a four-bar parallelogram linkage is defined whereby elevation of the lower boom assembly relative to the post causes floating frame 114 to be elevated in a level attitude.

An upper parallelogram boom assembly 128 is carried on the upper end of floating frame 114. This upper boom assembly includes a compression arm 130 and tension arm 132. The arms 130 and 132 extend in an offset or zigzag path in plan view so as to clear the side of lower boom 104 when in the retracted mode. Arm 130 includes a short proximal end 134 pivotally mounted between the upper ends of side plates 116, 118 through pin connection 136. A longer distal end 138 is secured to the side of end 134 by means of the pair of plates 140, 142. Distal end 138 is pivotally mounted through pin connection 144 between side arms 146 and 148 of a bifurcated end frame 150. Tension arm 132 similarly includes a short proximal end 152 pivotally mounted through a pin connection 154 between the side plates of the floating frame. A larger distal end 156 is secured to the side of end 152 by plates 158, and the end 156 is pivotally mounted through pin connection 160 with end frame 150. The spacing between pin connections 144 and 160 is equal to the spacing between pin connections 136 and 154 so that a four-bar parallelogram linkage is defined such that pivotal movement of boom assembly 128 relative to the floating frame causes end frame 150 to elevate with a level attitude.

A platform 162 is mounted on a column 164 which extends upwardly from end frame 150. The platform comprises a horizontally flat floor 166 which supports four upstanding corner posts 168, 170. Four perimeter safety rails 172, 174 are mounted across the upper ends of the corner posts. A manually operated control panel 176 is mounted on the safety rails and a control cable 178 extends from the panel down through column 164 and through the boom assemblies to the support frame 92. An access ladder 180 is mounted on one side of the column below the platform to permit workman to climb up to the platform from the ground when the apparatus is in its retracted or stowed mode.

A rigid tension link 182 interconnects the upper and lower compression arms 130 and 106 for synchronizing pivotal movement of the upper boom assembly at a predetermined angular rate with respect to the lower boom assembly. In the embodiment of apparatus 90 the two booms are pivoted at equal angular rates so that the platform is elevated with a level attitude and without horizontal displacement or sway. Tension link 182 is elongate and extends through the inside of floating frame 114. The lower end of the link is mounted through a pin connection 184 to the distal end of lower compression arm 106 while the upper end of the link is mounted through a pin connection 186 to the proximal end 134 of the upper compression arm. The longitudinal axis of link 182 lies across a line intersecting the pin connections 124, 136 so that the upper boom assembly is pivoted through an angle opposite to that of the lower boom assembly. Also the spacing between the lower pin connection 184 of the link and pin connection 124 is equal to the spacing between the upper pin connection 186 and pin connection 136 such that the rate of angular movement of the lower boom assembly relative to the floating frame is substantially equal to the rate of angular movement between the floating frame and upper boom assembly 104 in a manner similar to that described for the embodiment of FIG. 1.

Lower boom assembly 104 is raised and lowered for elevating and retracting the platform by means of a linear actuator, preferably comprising the hydraulic cylinder 188. The cylinder is pivotally connected at its head end to post 102 by a bracket 190, and is pivotally connected at its rod end to compression arm 106 by a bracket 192. The cylinder is operated by pressurized fluid from the hydraulic control circuit under influence of control panel 176.

In operation of the embodiment of FIG. 3, the boom assemblies 104, 128 and platform 162 are initially in the retracted or stowed mode illustrated in solid line in FIG. 4. The workman climbs up ladder 180 to gain access to the platform. The controls on panel 176 are then manipulated to operate the hydraulic control circuit and extend actuator 188. As the actuator extends, lower boom assembly 104 is pivoted upwardly relative to post 102, thereby carrying floating frame 114 upwardly through an arc in a level attitude. Compression arm 106 undergoes a clockwise pivotal movement, as viewed in FIG. 4, relative to the floating frame and this pulls tension link 182 which applies a counterclockwise moment force to the proximal end 134 of the upper compression arm. Upper boom assembly 128 is thereby pivoted upwardly in a counterclockwise direction relative to the floating frame, and this in turn moves end frame 150 upwardly in a level attitude until the fully elevated position 150' is reached, as shown in phantom in FIG. 4. The horizontal component of movement of the platform relative to floating frame 114 is cancelled out by the equal and opposite horizontal component of movement between the floating frame and support base 92 so that the platform is raised without horizontal displacement or sway, thereby minimizing discomfort to workmen riding on the platform. The platform is returned to its stowed mode by manipulating the control panel to retract actuator 188 and pivot lower boom assembly 104 downwardly in a counterclockwise direction. Tension link 182 restrains downward pivotal movement of upper boom assembly 128 at an angular rate equal to that of the lower boom assembly so that the platform is lowered in a level attitude and without undesirable horizontal displacement or sway.

While the foregoing embodiments are at present considered to be preferred, it is understood that numerous variations and modifications may be made therein by those skilled in the art, and it is intended to cover in the appended claims all such variations and modifications as fall within the true spirit and scope of the invention.

What is claimed is:

1. In an aerial lift apparatus having a main support frame, the combination of a first parallelogram boom assembly including a pair of elongate parallel first arms mounted at their proximal ends on the support frame and extending at an upwardly inclined angle from the support frame, a floating frame pivotally mounted on the distal ends of the first arms, at least a second parallelogram boom assembly including a pair of elongate parallel second arms pivotally mounted at their proximal ends on the floating frame adjacent said pivotal mounting between the first arms and floating frame, said second arms extending at an angle which inclines upwardly from said base in a direction opposite said inclined angle of the first arms, an end frame pivotally mounted on the distal ends of the second arms, rigid tension link means interconnected between the distal end of one of the first arms and a proximal end of one of the second arms for applying a moment force on the latter to pivot the second boom assembly in an angular direction about the floating frame which is opposite to the angular direction of pivoting of the first arms relative to the main support frame, and means for pivoting the first arms relative to the main support frame.

2. Aerial lift apparatus as in claim 1 in which the first arms are substantially equal length whereby pivoting of such arms relative to the support frame raises and lowers the floating frame in a level attitude, the second arms are of substantial equal length whereby pivoting of the second arms relative to the floating frame raises and lowers the end frame in a level attitude thereof, and the tension link means is sized and positioned to pivot the second arms at a equal angular rate with respect to the angular rate of pivotal movement between the first arms and floating frame whereby the end frame is caused to be raised and lowered without substantial horizontal displacement.

3. Aerial lift apparatus as in claim 1 in which said support base includes an upstanding post and said first arms are pivotally mounted at their proximal ends to an upper portion of said post for movement between a downwardly inclined retracted position and an upwardly inclined extended position, said floating frame is mounted on and extends upwardly from the distal ends of the first arms, and said second arms are mounted on an upper portion of the floating frame and incline downwardly therefrom when said first arms are in a retracted position.

4. Aerial lift apparatus as in claim 3 in which said second arms are formed with a portion having a zigzag shape in plan, said zigzag portion being positioned in side-by-side relationship with the first arms for providing clearance therewith when said arms are in their retracted positions.

* * * * *